United States Patent [19]

Kreiser

[11] 4,017,714

[45] Apr. 12, 1977

[54] SEGMENTED SACRIFICIAL ANODE ATTACHMENT TO WATER HEATING ELEMENT

[75] Inventor: C. Fred Kreiser, Boca Raton, Fla.

[73] Assignee: Electro-Therm, Inc., Laurel, Md.

[22] Filed: Aug. 4, 1975

[21] Appl. No.: 601,900

[52] U.S. Cl. ..... 219/322; 204/196

[51] Int. Cl.[2] ..... F24H 1/00

[58] Field of Search ..... 219/318, 322; 204/196

[56] References Cited

UNITED STATES PATENTS

| | | | |
|---|---|---|---|
| 2,723,340 | 11/1955 | Boggs et al. | 219/336 X |
| 3,098,027 | 7/1963 | Flower | 204/196 |
| 3,134,731 | 5/1964 | Heuze | 204/196 |

*Primary Examiner*—C. L. Albritton

*Attorney, Agent, or Firm*—Richard G. Kinney; Thomas R. Vigil; Henry W. Collins

[57] ABSTRACT

The attachment is easily replaced, is flexible and elongated, and is adapted to be inserted into a tank for heating a liquid through an opening provided in the metal shell of the tank for mounting an electric immersion heater in the tank. The attachment includes a chain of metal segments which are interconnected by flexible metal wire and which are anodic to the metal shell, and includes a clamp for releasably, and electrically and mechanically, connecting one end of the chain of segments to the sheathed and grounded legs of the immersion heater.

18 Claims, 8 Drawing Figures

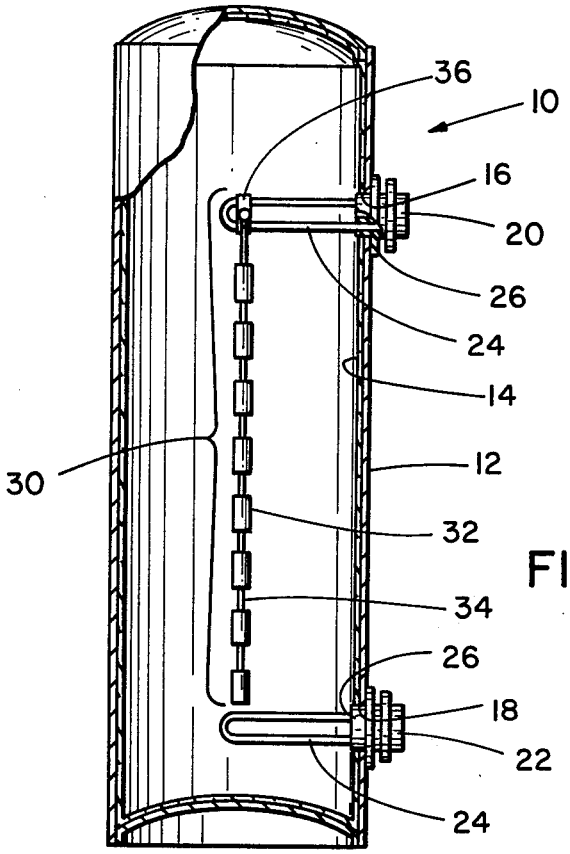
FIG.1
FIG.2
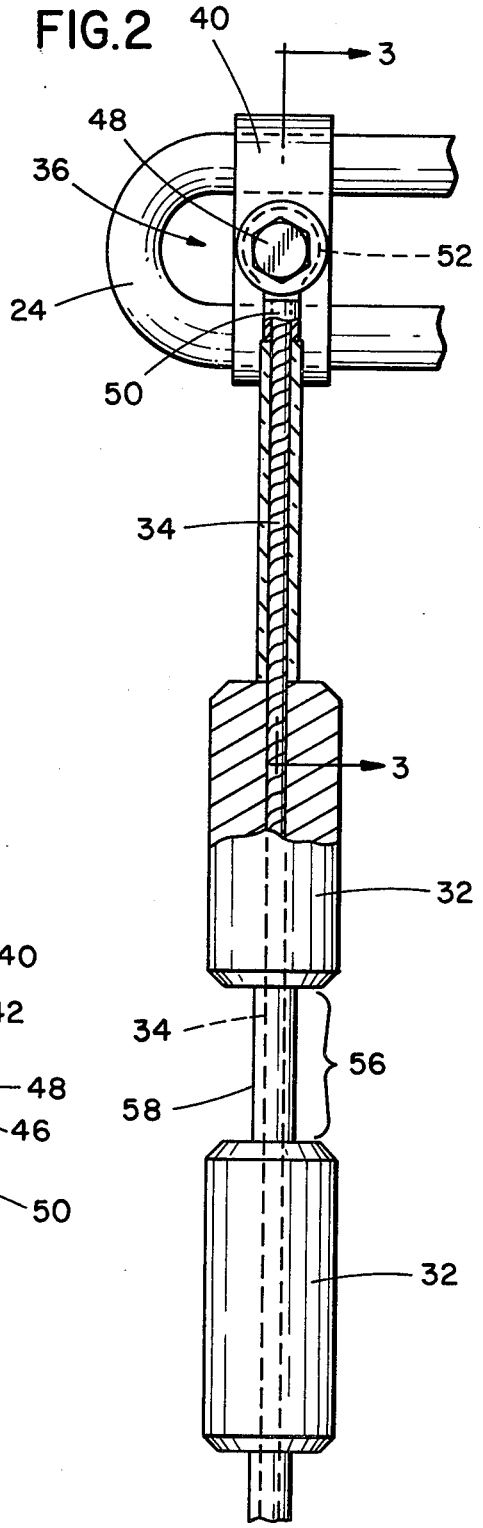
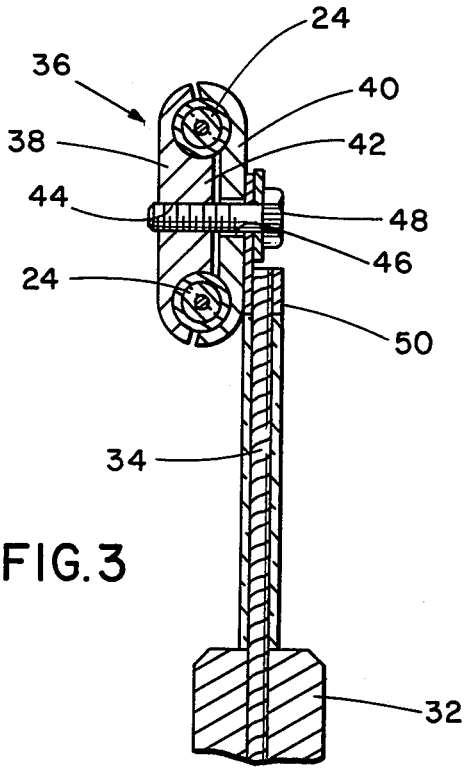
FIG.3

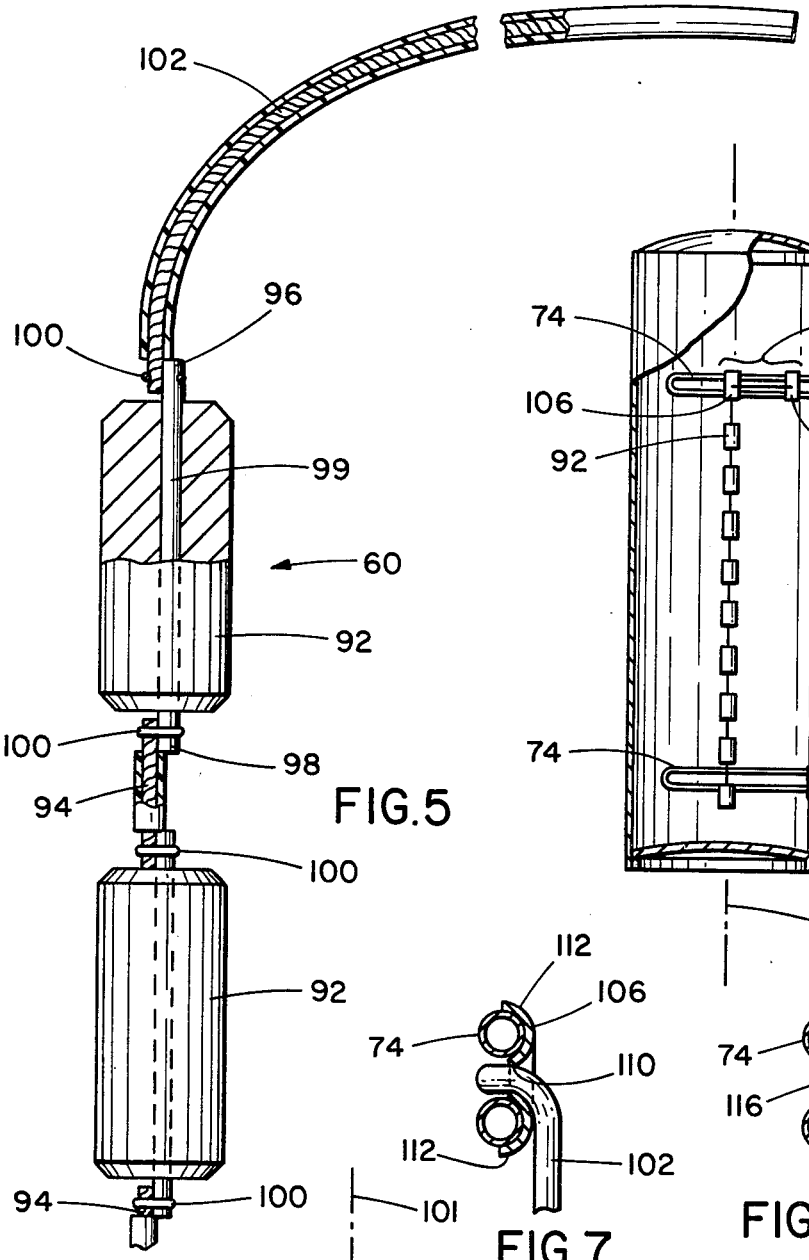
FIG.5
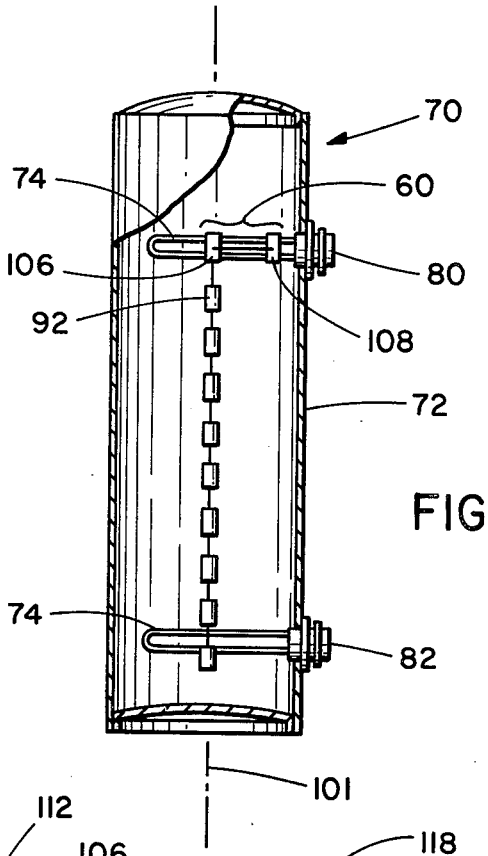
FIG.4
FIG.7
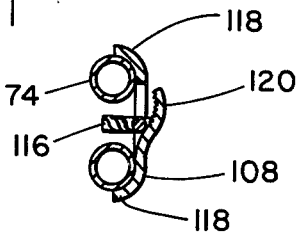
FIG.8
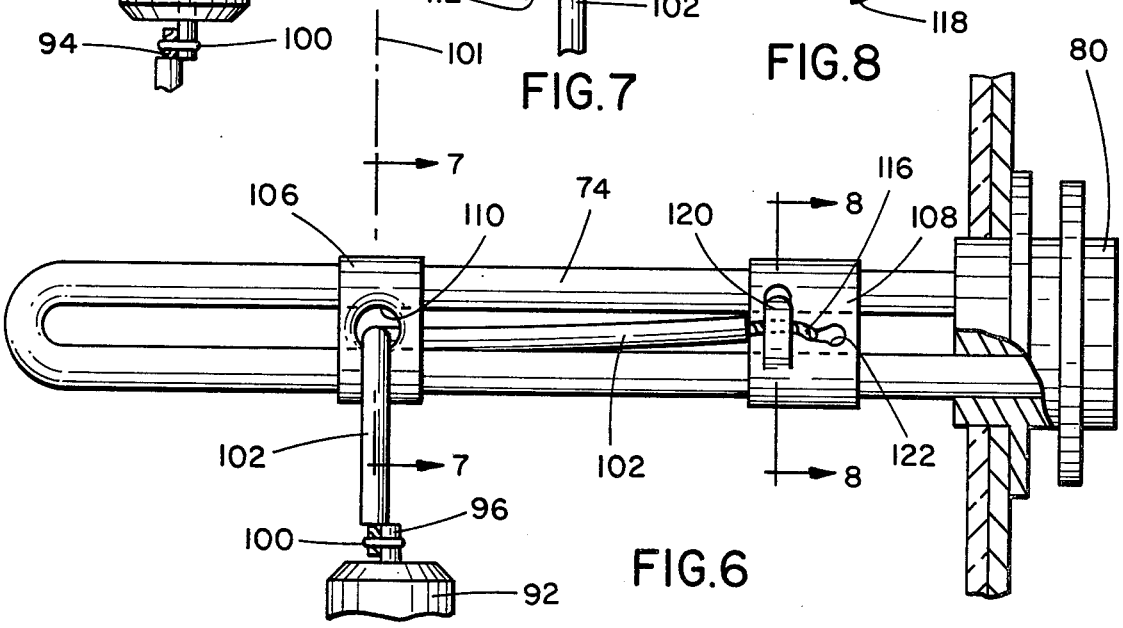
FIG.6

SEGMENTED SACRIFICIAL ANODE ATTACHMENT TO WATER HEATING ELEMENT

BACKGROUND OF THE INVENTION

1. Field of the Invention

The present invention relates to, and the field of the invention is, sacrificial metal anodes utilized in the tank of an electric water heater having a metal shell to protect the shell from corrosion, i.e., the depletion of metal, due to the action of galvanic currents flowing in the water in the tank. This field of sacrificial metal anodes is presently classified in class 204 subclass 196 and class 219 subclasses 318, 322 and related classes.

More specifically, the present invention relates to an easily replaceable, flexible, elongate sacrificial anode attachment which is insertable into a water tank through an opening provided in the shell of the tank for mounting an electric immersion heater in the tank and which is electrically, mechanically and detachably connected to the legs of the heater situated in the tank.

2. Description of the Prior Art

It has been known for some time that galvanic currents in partially ionized water in the tank of an electric water heater cause corrosion of (depletion of metal from) the metal shell of the tank.

To combat this corrosion the inner surface of the metal shell is often coated with ceramic, glass, metal or other protective material. However, the coating is or may become faulty and it is difficult, if not impossible, to cover all exposed areas of the inner surface of the metal shell. Addditionally the galvanic currents often cause corrosion of the sheath surrounding the heating elements immersed in the tank. Consequently, in addition to coating the inner surface of the tank, it is customary to mount a sacrificial metal anode in the tank. The anode is made of a metal, typically magnesium, which is anodic to the metal shell, typically made of steel. With this arrangement, the galvanic currents will act upon the deplete metal from the sacrificial metal anode (which is made of a metal higher in the electromotive series than is the metal of which the shell is made) thereby to prevent depletion (corrosion) of metal from the metal shell.

Typically, the sacrificial metal anode is an elongate, magnesium rod which is secured to and depends from the top inner surface of the tank. Often the anode is mounted near the center-line of the tank and supported from a combination fitting received in a threaded opening in the top of the tank, the fitting and threaded opening serving also as an outlet for the hot water connection to the tank. In this arrangement, the anode is usually soldered into and forms a solid part of the plumbing system. As such the anode is accessible only after removing the top outer jacket of the water heater. This can be accomplished only after disconnecting the hot and cold water pipes and frequently after disconnecting the electric power as well.

Also, because of limited "head room" above an installed water heater, it is almost impossible to insert a replacement, elongate, magnesium anode rod into the top threaded opening. Replacement could, of course, be accomplished by fully disconnecting the water heater and tipping it over onto its side.

From the forgoing remarks, it is apparent that replacement of a conventional elongate sacrificial anode entails considerable labor and is time consuming and cumbersome.

Such replacement is often desirable, however, due to the depletion of the metal anode, typically 4 or 5 years after the installation of the tank.

To permit a simplified replacement of the sacrificial anode, it has heretofore been proposed to form the anode as a closed tube, sheath or cover which is suitably joined or attached to the heater unit. More specifically, the anode is fitted over or about the sheathed hairpin shaped heating element of the electric immersion heater and forms a part thereof which is inserted into the tank through the opening provided therefor. In this way, both the heating element and sacrificial anode are simply mounted in the tank and are easily replaced. An example of such an anode can be found in U.S. Pat. No. 3,176,115 issued to E. W. Balis on March 30, 1965.

The sacrificial anode attachment of the present invention differs from the combination heating element and anode disclosed in the patent referred to above, by providing an elongate, flexible anode which does not isolate the heating element sheath from direct contact with the water, which provides considerably more anode material and more anode surface area in contact with the water, and which correctly locates the anode near the central vertical axis of the tank to yield nearly uniform galvanic current flow to all interior surface areas of the tank.

SUMMARY OF THE INVENTION

According to the invention there is provided for use in a tank for heating a liquid wherein the tank includes a metal shell of which at least some portion thereof is exposed to the liquid and which has at least one opening therein for mounting an electric immersion heater in the tank, flexible, elongate means for insertion into the tank through the opening for connection to a sheathed leg of the immersion heater grounded to the metal shell for establishing a replaceable sacrificial anode which is anodic to the metal shell and which is suspended from the sheathed leg.

BRIEF DESCRIPTION OF THE DRAWINGS

FIG. 1 is an elevational view partially in section of a water tank having two electric immersion heaters mounted therein and incorporating one embodiment of the segmented sacrificial anode attachment of the present invention.

FIG. 2 is an enlarged elevational view of the upper end of the anode attachment shown in FIG. 1 connected to and suspended from the sheathed legs of the upper immersion heater.

FIG. 3 is a sectional view of the clamp at the upper end of the anode attachment and is taken along line 3—3 of FIG. 2.

FIG. 4 is similar to FIG. 1 and is an elevational view partially in section of a water tank having another embodiment of the segmented sacrificial anode attachment of the present invention mounted therein.

FIG. 5 is an enlarged, fragmentary, elevational view of the upper end of the anode attachment shown in FIG. 4 before it is mounted to an upper immersion heater in the water tank.

FIG. 6 is an enlarged, fragmentary, elevational view of the clips for locating and grounding the anode attachment on and to the upper immersion heater.

FIG. 7 is a sectional view of the locating clip shown in FIG. 6 and is taken along line 7—7 of FIG. 6.

FIG. 8 is a sectional view of the grounding clip shown in FIG. 6 and is taken along line 8—8 of FIG. 6.

DESCRIPTION OF THE PREFERRED EMBODIMENTS

Referring now to the drawings in greater detail, a water tank is shown in FIG. 1 and identified by the reference numeral 10. The tank includes a metal shell 12 having an inner protective lining (e.g., a glass lining) 14.

The tank 10 also has an upper opening 16 and a lower opening 18 in the wall thereof for receiving and mounting electric immersion heaters 20 and 22. The heaters 20 and 22 illustrated in the drawings are identical and are of the so-called hairpin type which includes a U-shaped, sheathed, heating element 24. The metal sheath of each element 24 is received in, and in electrical contact with, a metal mounting block 26 of the heater 20 or 22 which is fixed in the respective opening 16 or 18 by suitable fasteners not shown. The block 26 is in electrical contact with the metal shell 12 which is connected to electrical ground so that the metal sheath is "grounded." The construction and arrangement of the elements described above define a conventional electric water heater and form no part of the present invention.

As shown in FIG. 1, one embodiment of a segmented sacrificial anode attachment 30 constructed and arranged in accordance with the teachings of the present invention is releasably secured to and suspended from the sheathed element 24 of the upper heater 20. The attachment 30 includes a plurality of spaced apart metal segments 32 which are interconnected by a flexible metal wire 34 into a chain and which are made of a metal, such as magnesium, which is anodic to the metal shell. In the illustrated embodiment, and as best shown in FIGS. 2 and 3, the attachment also includes a two piece clamp 36 releasably and mechanically connected to the two legs of sheathed heating element 24 and in electrical contact with the metal sheath thereof.

The clamp 36 can be of any configuration provided it can fit easily through the opening 16 and can be easily secured to the legs of the sheathed heating element 24. The clamp 36 meets these conditions and includes a generally T-shaped piece 38 and a mating generally flat piece 40 which fit between and in contact with the legs of the sheathed heating element 24. A center leg 42 of the piece 38 has a threaded bore 44 therein and the piece 40 has a hole 46 therethrough aligned with the bore 44. A threaded fastener 48 extends through the hole 46 and is threadingly received in the bore 44. By tightening the fastener 48 the pieces 38 and 40 are urged toward each other and in gripping engagement with the sheathed legs of the heating element 24.

Note that the length of the clamp 36 is essentially no more than the lateral width or extent of the U-shaped heating element 24 so that the clamp 36, mounted on the element 24, can be easily inserted through the opening 16.

An upper end 50 of the wire 34 is fixed in an eyelet 52 having a center opening sized to receive the fastener 48 therethrough. With this construction and arrangement, the fastener 48 is utilized not only for fastening the clamp 36 electrically and mechanically to the element 24, but also for electrically and mechanically connecting the wire 34 to the clamp 36.

Preferably, to minimize depletion of metal from exposed portions 56 of the wire 34 between anode segments 32, the portions 56 have an insulating, protective coating or covering 58 thereon.

The segments 32 resemble sausage links or beads on a necklace and the interconnecting flexible wire 34 permits the anode attachment 30 to be folded or bent in the same manner as a plurality of sausage links or a necklace thereby allowing the segments 32 to be inserted easily through the opening 16 into the tank 10.

Also, the plurality of segments 32 can be easily formed from a conventional magnesium anode rod which has a flexible metal wire in the center thereof simply by cutting, punching or pressing away portions of the rod surrounding the wire at equidistant spaced apart intervals.

To install the attachment 30 one first assembles the pieces 38 and 40 about the legs of the element 24 near the bight portion thereof with fastener 48 extending through the eyelet 52, the hole 46 and into the bore 44. The fastener 48 is screwed into the bore 44 until a snug but not tight fit is obtained which permits the eyelet 52 to be rotated.

The end 50 of the wire 34 is then rotated to a position generally parallel to the legs of the sheathed element 24. The segments 32 are then inserted through the opening 16 into the tank 10 followed by the inner end or bight portion of the element 24 and clamp 36 thereon. Then the end 50 is rotated to a position generally perpendicular to the legs of the element 24 and a tool, such as a box wrench, is inserted into the opening 16 for tightening the fastener 48. Afterwards the block 26 is fitted into the opening 16 and the heater 20 is secured in place. With this arrangement, the sacrificial anode attachment 30 can be easily and quickly replaced to provide anode protection to prevent leaks in the tank 10 due to corrosion caused by galvanic current action and thereby provide a longer useful life for the tank 10 and the electric water heater including same.

Another embodiment of the segmented sacrificial anode attachment of the invention is shown in FIG. 4 and is generally identified by the reference numeral 60. The anode attachment 60 is situated in a tank 70 having a metal shell 72 and is releasably secured to and suspended from heating element 74 of the upper one of two electric immersion heaters 80 and 82. The heaters 80 and 82 are essentially identical to the heaters 22 and 24 shown in FIG. 1 and the sheathed elements 74 thereof are grounded to the metal shell 72 in the same manner as the sheathed elements 24 are grounded to the metal shell 12 shown in FIG. 1 and as described above.

The attachment 60 includes a plurality of spaced apart metal segments 42 similar to the segment 32. However, instead of being interconnected by a continuous core wire they are connected by sections 94 of stranded, flexible wire which are attached to opposite extending end portions 96 and 98 of a core wire 99 in each segment 92. The flexible wire sections 94 are attached to end portions 96 and 98 by crimping an oval barrel connector 100 around the adjacent end portion 96 or 98 in such a way that the flexible wire section 94 and core wire end portion 96 or 98 are securely joined together. This embodiment of the segmented anode attachment is used where the core wire is too rigid and link shaped segments interconnected by the core wire will not hang vertically from the element 74 along a central vertical axis 101 of the tank 70. The segments 92 are, of course, made of a metal, such as magnesium which is anodic to the metal shell 72. Also the flexible wire sections 94 are plastic-covered to minimize corrosion of the wire sections 94.

Additionally, in this embodiment, the attachment 60 includes a plastic-covered, stranded, flexible lead wire 102 connected to the end portion 96 of the uppermost segment 92 in the chain of segments 92 instead of an extension of the core wire such as end wire 50 in FIGS. 1 to 3. The lead wire 102 simplifies the insertion of the chain of segments 92 into the tank 70 with the free end of the lead wire 102 extending out of the tank for connection to the sheathed element 74 prior to the mounting of the heater 80 in the tank 70.

Instead of a single clamp as shown in FIGS. 1 to 3, the attachment 60 shown in FIGS. 4–8 includes two clips 106 and 108, one being a locating or centering clip 106 and the other being a grounding clip 108, for releasably, mechanically and electrically securing the chain of anode segments 92 to the sheathed element 74.

The clip 106 is in the form of a rectangular bracket with a hole 110 therein and with upper and lower curved margins 112 which locate the clip on the legs of element 74 as best shown in FIGS. 6 and 7. The margins 112 are secured, such as by solder, to the legs of the element 74 with the hole 110 located at a point on element 74 which is aligned with the axis 101 of the tank 70 when the heater 80 is mounted in the tank 70.

As shown in FIG. 6, the lead wire 102 extends through the hole 110 of clip 106 which locates the chain of anode segments 92 on the axis 101 and to the grounding clip 108 where a bare end 116 of lead wire 102 is mechanically secured and electrically grounded to the clip 108.

The clip 108 is also a generally rectangular bracket and has curved margins 118, a Fahnestock type mounting clip structure 120 and a keyhole shaped opening 122. The structure 120 is defined by a pressed out prong having serrations on the underside thereof. The bare end 116 of lead wire 102 is received between the prong 120 and the body of clip 108 and into the keyhole shaped opening 122. The prong is closed (bent) over the bare end 116 of lead wire 102 to anchor the lead wire 102 and ground the same to the sheath of element 74, and hence to the tank shell 72.

The curved margins 118 facilitate locating of the clip 108 on the element 74 and, as shown, the clip 108 is mounted, i.e., soldered, to the element 74 adjacent the mounting block for heater 80.

Clips 106 and 108 are preferably made of copper and are tinned in the area of the margins 112 and 118 which are soldered to the sheathed element 74.

In this embodiment, a replacement heater 80 may be sold with clips 106 and 108 already soldered in place and in the proper locations therefor. The anode attachment 60 can be sold with a replacement heater 80 or separately and the lead wire 102 can be provided with extra length which facilitates insertion of the anode attachment in the tank 70 and which can be cut off.

In mounting the anode attachment 60 and a replacement heater 80, the chain of segments 92 is first inserted into the tank with lead wire 102 extending out of the tank. Then the lead wire 102 is fed through the opening 110 in clip 106 and pulled tight under prong 120 and into the keyhole shaped opening 122. Any excess lead wire can be cut off and the end 116 can be laid bare if it was not skinned previously. The bare end 116 then can be reinserted under prong 120 and into opening 122. Next the prong 120 is pressed over the bare end 116 to anchor is in place. Now the heater 80 can be mounted in the tank 70.

When the heater 80 is of the so-called "screw-in" type, a longer lead wire 102 can be provided allowing it to be wrapped around the legs of the element 74. The extra length is such that it pulls the chain of anode segments 92 up to position just below the legs of the element 74 when the screw-plug-header has seated in the spud in the tank wall. It is shortened when the heater bolts in.

From the foregoing description it is apparent that the present invention has a number of advantages some of which have been described above and others of which are inherent in the invention. Also it will be apparent that obvious modifications can be made to the sacrificial anode attachments 30 and 60 of the invention without departing from the spirit of the invention. Accordingly, the scope of the invention is only to be limited as necessitated by the accompanying claims.

I claim:

1. A segmented sacrificial anode attachment comprising a chain of discrete metal segments interconnected by a flexible metal conductor and adapted to be inserted through an opening provided in a metal shell of a tank for mounting an electric immersion heater in the tank, said segments being made of a metal which is anodic to the metal shell of the tank, and means for electrically and mechanically connecting one end of said chain of segments to a sheathed leg of an electric immersion heater grounded to the metal shell of the tank.

2. The attachment according to claim 1 wherein said connecting means includes a lead wire connected to said one end of said chain segments and wherein said connecting means is releasably attached to the sheathed and grounded leg.

3. The attachment according to claim 2 wherein said connecting means includes means for releasably securing one end of said lead wire to said connecting means.

4. The attachment according to claim 1 wherein said connecting means includes a metal clamp which is constructed and arranged to releasably clamp about a sheathed leg of the heater.

5. The attachment according to claim 4 wherein said clamp includes means for releasably securing said one end of said chain of segments to said clamp.

6. The attachment according to claim 1 including insulating means on the exposed portions of said flexible metal conductor extending between said metal segments.

7. The attachment according to claim 1 wherein said segments are made of magnesium.

8. In a tank for heating a liquid, the tank including a metal shell with at least one opening for mounting an electric immersion heater therein, an electric immersion heater grounded to the metal shell and mounted in the tank through said opening, and anode means which are anodic to the metal shell of the tank carried within the tank to prevent corrosion, the improvement comprising a replaceable segmented sacrificial anode insertable into said tank through said opening which includes a plurality of discrete metal segments interconnected by a flexible metal conductor and means for removably, electrically and mechanically connecting said plurality of segments to said heater for grounding said anode to the metal shell of said tank.

9. For use in a tank for heating a liquid wherein the tank includes a metal shell of which at least some portion thereof is exposed to the liquid, an electric immersion heater grounded to the metal shell for heating the liquid contained in the tank, and which has at least one opening therein for mounting the electric immersion heater in the tank, a flexible, elongate sacrificial anode means insertable into the tank through said opening suspended from and electrically connected to a sheathed element of the immersion heater for establishing a replaceable sacrificial anode which is anodic to the metal shell.

10. The flexible, elongate means according to claim 9 including a chain of anodic metal segments interconnected by flexible metal wire and means for electrically and mechanically connecting one end of said wire to the sheathed element which is grounded to the metal shell.

11. The flexible, elongate means according to claim 10 wherein said connecting means comprises a metal clamp constructed and arranged to releasably clamp about the sheathed element and having means for releasably securing said one end of said wire to said clamp.

12. The flexible, elongate means according to claim 9 including a plurality of anodic metal segments interconnected in a chain by sections of flexible wire.

13. The flexible, elongate means according to claim 12 wherein said wire sections are covered with insulating material.

14. The flexible, elongate means according to claim 12 including means for releasably, electrically and mechanically connecting one end of said chain of segments to the sheathed element.

15. The flexible, elongate means according to claim 14 wherein said connecting means includes a centering clip fixed to the sheathed element for suspending said chain of segments from the element on the vertical central axis of the tank.

16. The flexible, elongate means according to claim 14 wherein said connecting means includes a grounding clip fixed to the sheathed element for electrically grounding said chain of segments to the metal sheath of the element and hence to the metal shell of the tank.

17. The flexible, elongate means according to claim 14 wherein said connecting means includes a lead wire connected to one end of said chain of segments, a centering clip fixed to the sheathed element and having a hole therein through which said lead wire extends, said centering clip being located at a position on the element where the chain of segments will hang from the element substantially on the vertical central axis of the tank, and a grounding clip mechanically and electrically connected to the sheathed element, said lead wire having a bare free and releasably secured to said grounding clip.

18. The flexible, elongate means according to claim 17 wherein said grounding clip includes a Fahnestock clip and a keyhole shaped opening for securing said bare end of said lead wire to said grounding clip.

* * * * *

UNITED STATES PATENT AND TRADEMARK OFFICE

CERTIFICATE OF CORRECTION

PATENT NO. : 4,017,714

DATED : April 12, 1977

INVENTOR(S) : C. Fred Kreiser

It is certified that error appears in the above-identified patent and that said Letters Patent are hereby corrected as shown below:

Column 6, line 34, after "chain" insert therefor -- of --.

Column 8, line 25, delete "and" and insert therefor -- end --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*